US005950155A

United States Patent [19]

Nishiguchi

[11] Patent Number: 5,950,155

[45] Date of Patent: Sep. 7, 1999

[54] APPARATUS AND METHOD FOR SPEECH ENCODING BASED ON SHORT-TERM PREDICTION VALVES

[75] Inventor: Masayuki Nishiguchi, Kanagawa, Japan

[73] Assignee: Sony Corporation, Tokyo, Japan

[21] Appl. No.: 08/676,226

[22] PCT Filed: Dec. 19, 1995

[86] PCT No.: PCT/JP95/02607

§ 371 Date: Sep. 18, 1996

§ 102(e) Date: Sep. 18, 1996

[87] PCT Pub. No.: WO96/19798

PCT Pub. Date: Jun. 27, 1996

[30] Foreign Application Priority Data

Dec. 21, 1994 [JP] Japan ..... P6-318689

[51] Int. Cl.[6] ..... G10L 5/02

[52] U.S. Cl. ..... 704/230; 704/219

[58] Field of Search ..... 395/2.19, 2.2, 395/2.21, 2.37, 2.28, 2.32, 2.17; 704/219, 222, 230, 262

[56] References Cited

U.S. PATENT DOCUMENTS

| | | | |
|---|---|---|---|
| 4,791,670 | 12/1988 | Copperi et al. | 395/2.28 |
| 4,811,396 | 3/1989 | Yatsuzuka | 381/30 |
| 4,817,157 | 3/1989 | Gerson | 395/2.29 |
| 4,860,355 | 8/1989 | Copperi | 395/2.28 |
| 5,007,092 | 4/1991 | Galand et al. | 381/36 |
| 5,202,926 | 4/1993 | Miki | 395/2.28 |
| 5,327,320 | 7/1994 | Chen | 395/2.28 |
| 5,371,853 | 12/1994 | Kao et al. | 395/2.32 |
| 5,414,796 | 5/1995 | Jacobs et al. | 395/2.31 |
| 5,487,086 | 1/1996 | Bhaskar | 375/243 |
| 5,491,771 | 2/1996 | Gupta et al. | 395/2.32 |
| 5,533,052 | 7/1996 | Bhaskar | 375/244 |
| 5,546,498 | 8/1996 | Sereno | 395/2.38 |
| 5,602,959 | 2/1997 | Bergstrom et al. | 395/2.28 |
| 5,602,961 | 2/1997 | Kolesnik et al. | 395/2.32 |
| 5,642,465 | 6/1997 | Scott et al. | 395/2.29 |
| 5,651,026 | 7/1997 | Lin et al. | 375/240 |
| 5,699,481 | 12/1997 | Shlomot et al. | 395/2.37 |
| 5,699,485 | 12/1997 | Shoham | 395/2.32 |
| 5,710,863 | 1/1998 | Chen | 395/2.39 |
| 5,732,389 | 3/1998 | Kroon et al. | 704/223 |

OTHER PUBLICATIONS

Schroeder, Mangred Code Excited Linear Prediction (CELP): High Quality Speech at Very Low Bit Rates, Internation Conference on Acoustics, Speech and Signal Processing 85, vol. 3, Mar. 1985 Tampa.

Rabiner et al. Fundamentals of Speech Recogntion. 129–131. 254, 1993.

*Primary Examiner*—David R. Hudspeth
*Assistant Examiner*—M. David Sofocleous
*Attorney, Agent, or Firm*—Jay H. Maioli

[57] ABSTRACT

Foe executing the code excitation linear prediction (CELP) coding, for example, α-parameters are taken out from the input speech signal by a linear prediction coding (LPC) analysis circuit 12. The α-parameters are then converted by an α-parameter to LSP converting circuit 13 into linear spectral pair (LSP) parameters and a vector of these line spectral pair (LSP) parameters is vector-quantized by a quantizer 14. The changeover switch 16 is controlled depending upon the pitch value detected by a pitch detection circuit 22 for selecting and using one of the codebook 15M for male voice and the codebook 15F for female voice for improving quantization characteristics without increasing the transmission bit rate.

19 Claims, 2 Drawing Sheets

APPARATUS AND METHOD FOR SPEECH ENCODING BASED ON SHORT-TERM PREDICTION VALVES

TECHNICAL FIELD

This invention relates to a speech encoding method for encoding short-term prediction residuals or parameters representing short-term prediction coefficients of an input speech signal by vector or matrix quantization.

BACKGROUND ART

There are a variety of encoding methods known for encoding an audio signal, inclusive of a speech signal and an acoustic signal, by exploiting statistical properties of the audio signal in the time domain and in the frequency domain and the psychoacoustic characteristics of the human hearing system. These encoding methods may be roughly classified into encoding on the time domain, encoding on the frequency domain and analysis/synthesis encoding.

If, in multi-band excitation (MBE), single-band excitation (SBE), harmonic excitation, sub-band coding (SBC), linear predictive coding (LPC), discrete cosine transform (DCT), modified DCT (MDCT) or fast Fourier transform (FFT), as examples of high-efficiency coding for speech signals, various information data, such as spectral amplitudes or parameters thereof, such as LSP parameters, α-parameters or k-parameters, are quantized, scalar quantization has been usually adopted.

If, with such scalar quantization, the bit rate is decreased to e.g. 3 to 4 kbps to further increase the quantization efficiency, the quantization noise or distortion is increased, thus raising difficulties in practical utilization. Thus it is currently practiced to group different data given for encoding, such as time-domain data, frequency-domain data or filter coefficient data, into a vector, or to group such vectors across plural frames, into a matrix, and to effect vector or matrix quantization, in place of individually quantizing the different kinds of data.

For example, in code excitation linear prediction (CELP) encoding, LPC residuals are directly quantized by vector or matrix quantization as time-domain waveform. In addition, the spectral envelope in MBE encoding is similarly quantized by vector or matrix quantization.

If the bit rate is decreased further, it becomes infeasible to use enough bits to quantize parameters specifying the envelope of the spectrum itself or the LPC residuals, thus deteriorating the signal quality.

In view of the foregoing, it is an object of the present invention to provide a speech encoding method capable of affording satisfactory quantization characteristics even with a smaller number of bits.

DISCLOSURE OF THE INVENTION

With the speech encoding method according to the present invention, a first codebook and a second codebook are formed by assorting parameters representing short-term prediction values concerning a reference parameter comprised of one or a combination of a plurality of characteristic parameters of the input speech signal. The short-term prediction values are generated based upon the input speech signal. One of the first and second codebooks concerning the reference parameter of the input speech signal is selected and the short-term prediction values are quantized by referring to the selected codebook for encoding the input speech signal.

The short-term prediction values are short-term prediction coefficients or short-term prediction errors. The characteristic parameters include the pitch values of the speech signal, pitch strength, frame power, voiced/unvoiced discrimination flag and the gradient of the signal spectrum. The quantization is the vector quantization or the matrix quantization. The reference parameter is the pitch value of the speech signal. One of the first and second codebooks is selected in dependence upon the magnitude relationship between the pitch value of the input speech signal and a pre-set pitch value.

According to the present invention, the short-term prediction value, generated based upon the input speech signal, is quantized by referring to the selected codebook for improving the quantization efficiency.

BEST MODE FOR CARRYING OUT THE INVENTION

Preferred embodiments of the present invention will be hereinafter explained.

Figure 1:
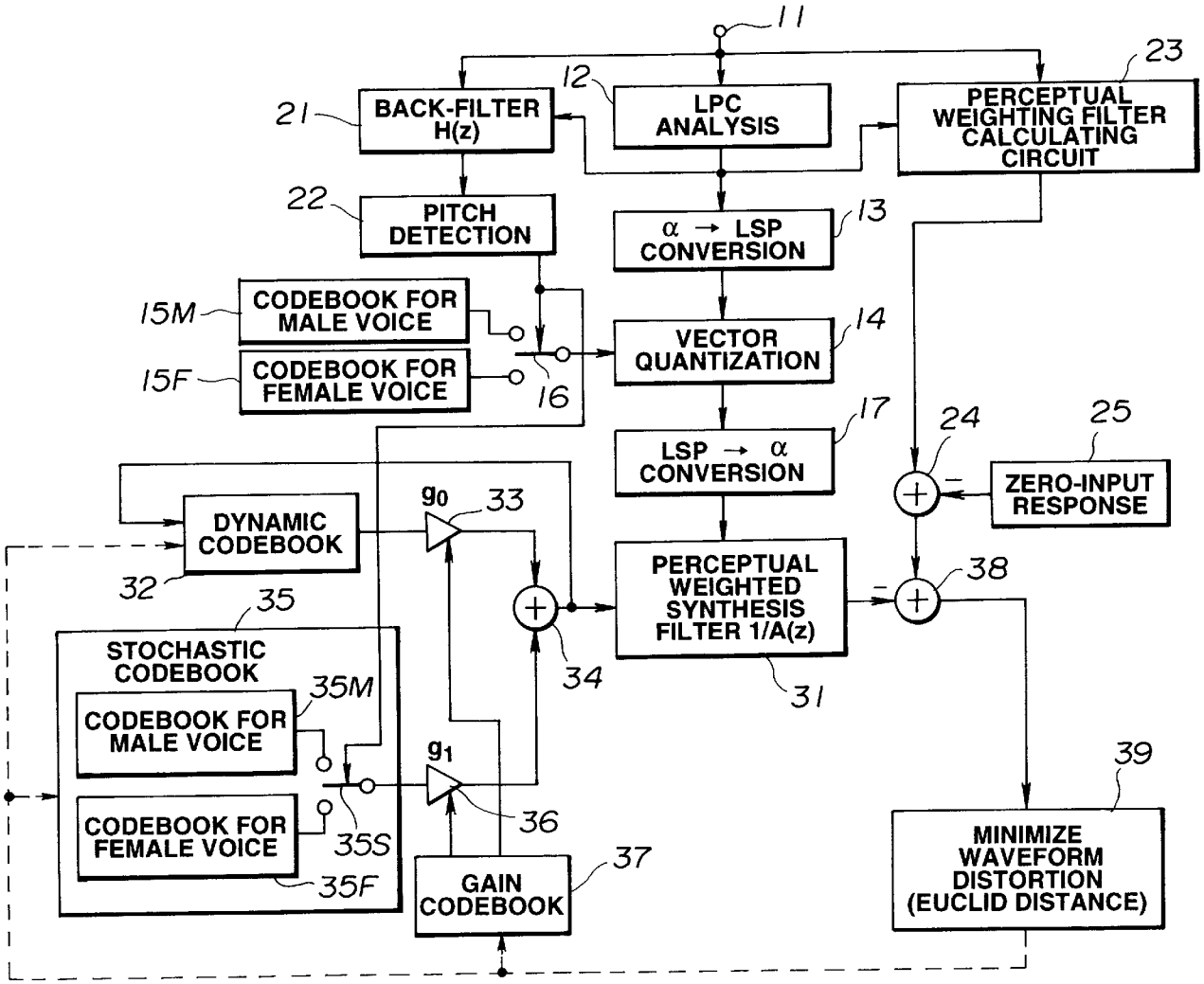
FIG. 1 is a schematic block diagram showing a speech encoding device (encoder) as an illustrative example of a device for carrying out the speech encoding method according to the present invention.

FIG. 1 is a schematic block diagram showing the constitution for carrying out the speech encoding method according to the present invention.

In the present speech signal encoder, the speech signals supplied to an input terminal 11 are supplied to a linear prediction coding (LPC) analysis circuit 12, a reverse-filtering circuit 21 and a perceptual weighting filter calculating circuit 23.

The LPC analysis circuit 12 applies a Hamming window to an input waveform signal, with a length of the order of 256 samples of the input waveform signal as a block, and calculates linear prediction coefficients or α-parameters by the auto-correlation method. The frame period, as a data outputting unit, is comprised e.g., of 160 samples. If the sampling frequency fs is e.g., 8 kHz, the frame period is equal to 20 msec.

The α-parameters from the LPC analysis circuit 12 are supplied to an α to LSP converting circuit 13 for conversion to line spectral pair (LSP) parameters. That is, the α-parameters, found as direct-type filter coefficients, are converted into e.g., ten, that is five pairs of, LSP parameters. This conversion is carried out using e.g., the Newton-Raphson method. The reason the α-parameters are converted into the LSP parameters is that the LSP parameters are superior to the α-parameters in interpolation characteristics.

The LSP parameters from the α to LSP conversion circuit 13 are vector-quantized by an LSP vector quantizer 14. At this time, the inter-frame difference may be first found before carrying out the vector quantization. Alternatively, plural LSP parameters for plural frames are grouped together for carrying out the matrix quantization. For this quantization, 20 msec corresponds to one frame, and the LSP parameters calculated every 20 msecs are quantized by vector quantization. For carrying out the vector quantization or matrix quantization, a codebook for male 15M or a codebook for female 15F is used by switching between the two with a changeover switch 16, in accordance with the pitch.

A quantization output of the LSP vector quantizer 14, that is the index of the LSP vector quantization, is provided, and the quantized LSP vectors are processed by a LSP to α conversion circuit 17 for conversion of the LSP parameters to the α-parameters as coefficients of the direct type filter. Based upon the output of the LSP to α conversion circuit 17, filter coefficients of a perceptual weighting synthesis filter 31 for code excitation linear prediction (CELP) encoding are calculated.

An output of a so-called dynamic codebook (pitch codebook, also called an adaptive codebook) 32 for code excitation linear prediction (CELP) encoding is supplied to an adder 34 via a coefficient multiplier 33 designed for multiplying a gain $g_0$. On the other hand, an output of a so-called stochastic codebook (noise codebook, also called a probabilistic codebook) is supplied to the adder 34 via a coefficient multiplier 36 designed for multiplying a gain $g_1$. A sum output of the adder 34 is supplied as an excitation signal to the perceptual weighting synthesis filter 31.

In the dynamic codebook 32 are stored past excitation signals. These excitation signals are read out at a pitch period and multiplied by the gain $g_0$. The resulting product signal is summed by the adder 34 to a signal from the stochastic codebook 35 multiplied by the gain $g_1$. The resulting sum signal is used for exciting the perceptual weighting synthesis filter 31. In addition, the sum output from the adder 34 is fed back to the dynamic codebook 32 to form a sort of IIR filter. The stochastic codebook 35 is configured so that the changeover switch 35S switches between the codebook 35M for male voice and the codebook 35F for female voice to select one of the codebooks. The coefficient multipliers 33, 36 have their respective gains $g_0$, $g_1$ controlled responsive to the outputs of the gain codebook 37. An output of the perceptual weighting synthesis filter 31 is supplied as a subtraction signal to an adder 38. An output signal of the adder 38 is supplied to a waveform distortion (Euclid distance) minimizing circuit 39. Based upon an output of the waveform distortion minimizing circuit 39, signal readout from the respective codebooks 32, 35 and 37 is controlled for minimizing an output of the adder 38, that is the weighted waveform distortion.

In the reverse-filtering circuit 21, the input speech signal from the input terminal 11 is back-filtered by the α-parameter from the LPC analysis circuit 12 and supplied to a pitch detection circuit 22 for pitch detection. The changeover switch 16 or the changeover switch 35S is changed over responsive to the pitch detection results from the pitch detection circuit 22 for selective switching between the codebook for male voice and the codebook for female voice.

In the perceptual weighting filter calculating circuit 23, a perceptual weighting filter calculation is carried out on the input speech signal from the input terminal 11 using an output of the LPC analysis circuit 12. The resulting perceptual weighted signal is supplied to an adder 24 which is also fed with an output of a zero input response circuit 25 as a subtraction signal. The zero input response circuit 25 synthesizes the response of the previous frame by a weighted synthesis filter and outputs a synthesized signal. This synthesized signal is subtracted from the perceptual weighted signal for canceling the filter response of the previous frame remaining in the perceptual weighting synthesis filter 31 for producing a signal required as a new input for a decoder. An output of the adder 24 is supplied to the adder 38 where an output of the perceptual weighting synthesis filter 31 is subtracted from the addition output.

In the above-described encoder, assuming that an input signal from the input terminal 11 is x(n), the LPC coefficients, i.e. α-parameters, are $\alpha_i$ and the prediction residuals are res(n). With the number of orders for analysis of P, $1 \leqq i \leqq P$. The input signal x(n) is back-filtered by the reverse-filtering circuit 21 in accordance with the equation (1):

$$H(z) = 1 + \sum_{i=1}^{P} \alpha^i Z^{-1} \tag{1}$$

for finding the prediction residuals(n) in a range e.g., of $0 \leqq n \leqq N-1$, where N denotes the number of samples corresponding to the frame length as an encoding unit. For example, N=160.

Next, in the pitch detection circuit 22, the prediction residual res(n) obtained-from the reverse-filtering circuit 21 is passed through a low-pass filter (LPF) for deriving resl(n). Such an LPF usually has a cut-off frequency fc of the order of 1 kHz in the case of the sampling clock frequency fs of 8 kHz. Next, the auto-correlation function $\Phi_{resl}(n)$ of resl(n) is calculated in accordance with the equation (2):

$$\phi_{resl}(i) = \sum_{n=0}^{N-i-1} resl(n)resl(n+i) \tag{2}$$

where $L_{min} \leqq i < L_{max}$.

Usually, $L_{min}$ is equal to 20 and $L_{max}$ is equal to 147 approximately. The pitch as found by tracking the number i which gives a peak value of the auto-correlation function $\Phi_{resl}(i)$ or the number i which gives a peak value by suitable processing is employed as the pitch for the current frame. For example, assuming that the pitch, more specifically, the pitch lag, of the k'th frame, is P(k). On the other hand, pitch reliability or pitch strength is defined by the equation (3):

$$Pl(k) = \Phi_{resl}(P(k))/\Phi_{resl}(0) \tag{3}$$

That is, the strength of the auto-correlation, normalized by $\Phi_{resl}(0)$, is defined as above.

In addition, as with the usual code excitation linear prediction (CELP) coding, the frame power $R_0(k)$ is calculated by the equation (4):

$$R_0(k) = \frac{1}{N}\sum_{i=0}^{N-1} x^2(n) \tag{4}$$

where k denotes the frame number.

Depending upon the values of the pitch lag P(k), pitch strength Pl(k) and the frame power $R_0(k)$, the quantization table for $\{\alpha_i\}$ or the quantization table formed by converting the α-parameters into line spectral pairs (LSPs) are changed over between the codebook for male voice and the codebook for female voice. In the embodiment of FIG. 1, the quantization table for the vector quantizer 14 used for quantizing the LSPs is changed over between the codebook for male voice 15M and the codebook for female voice 15F.

For example, if $P_{th}$ denotes the threshold value of the pitch lag P(k) used for making a distinction between the male voice and the female voice, and $Pl_{th}$ and $R_{0th}$ denote respective threshold values of the pitch strength Pl(k) for discriminating pitch reliability and the frame power $R_0(k)$, (i) a first codebook, e.g., the codebook for male voice 15M, is used for $P(k) \geqq P_{th}$, $Pl(k) > Pl_{th}$ and $R_0(k) > R_{0th}$;

(ii) a second codebook, e.g., the codebook for female voice 15F, is used for $P(k) \leqq P_{th}$, $Pl(k) > Pl_{th}$ and $R_0(k) > R_{0th}$; and (iii) a third codebook is used otherwise.

Although a codebook different from the codebook 35M for male voice and the codebook 35F for female voice may be employed as the third codebook, it is also possible to employ the codebook 35M for male voice or the codebook 35F for female voice as the third codebook.

The above threshold values may be exemplified e.g., by $P_{th}=45$, $Pl_{th}=0.7$ and $R_0(k)$=(full scale−40 dB).

Alternatively, the codebooks may be changed over by preserving past n frames of the pitch lags P(k), finding a mean value of P(k) over these n frames and discriminating the mean value with the pre-set threshold value $P_{th}$. It is noted that these n frames are selected so that $Pl(k) > Pl_{th}$, and $R_0(k) > R_{0th}$, that is so that the frames are voiced frames and exhibit high pitch reliability.

Figure 2:
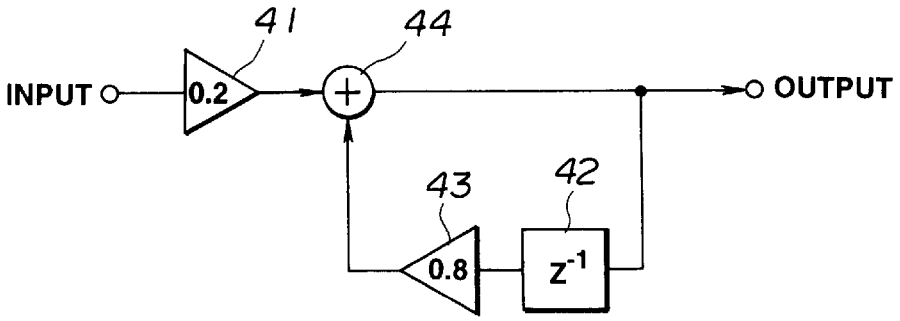
FIG. 2 is a circuit diagram for illustrating a smoother that may be employed for a pitch detection circuit shown in FIG. 1.

Still alternatively, the pitch lag P(k) satisfying the above condition may be supplied to the smoother shown in FIG. 2 and the resulting smoothed output may be discriminated by the threshold value $P_{th}$ for changing over the codebooks. It is noted that an output of the smoother of FIG. 2 is obtained by multiplying the input data with 0.2 by a multiplier 41 and summing the resulting product signal by an adder 44 to an output data delayed by one frame by a delay circuit 42 and multiplied with 0.8 by a multiplier 43. The output state of the smoother is maintained unless the pitch lag P(k), the input data, is supplied.

In combination with the above-described switching, the codebooks may also be changed over depending upon the voiced/unvoiced discrimination, the value of the pitch strength Pl(k) or the value of the frame power $R_0(k)$.

In this manner, the mean value of the pitch is extracted from the stable pitch section and discrimination is made as to whether or not the input speech is the male speech or the female speech for switching between the codebook for male voice and the codebook for female voice. The reason is that, since there is a deviation in the frequency distribution of the formant of the vowel between the male voice and the female voice, the space occupied by the vectors to be quantized is decreased, that is, the vector variance is diminished, by switching between the male voice and the female voice especially in the vowel portion, thus enabling satisfactory training, that is learning to reduce the quantization error.

It is also possible to change over the stochastic codebook in CELP coding in accordance with the above conditions. In the embodiment of FIG. 1, the changeover switch 35S is changed over in accordance with the above conditions for selecting one of the codebook 35M for male voice and the codebook 35F for female voice as the stochastic codebook 35.

For codebook learning, training data may be assorted under the same standard as that for encoding/decoding so that the training data will be optimized under e.g., the so-called LBG method.

Figure 3:
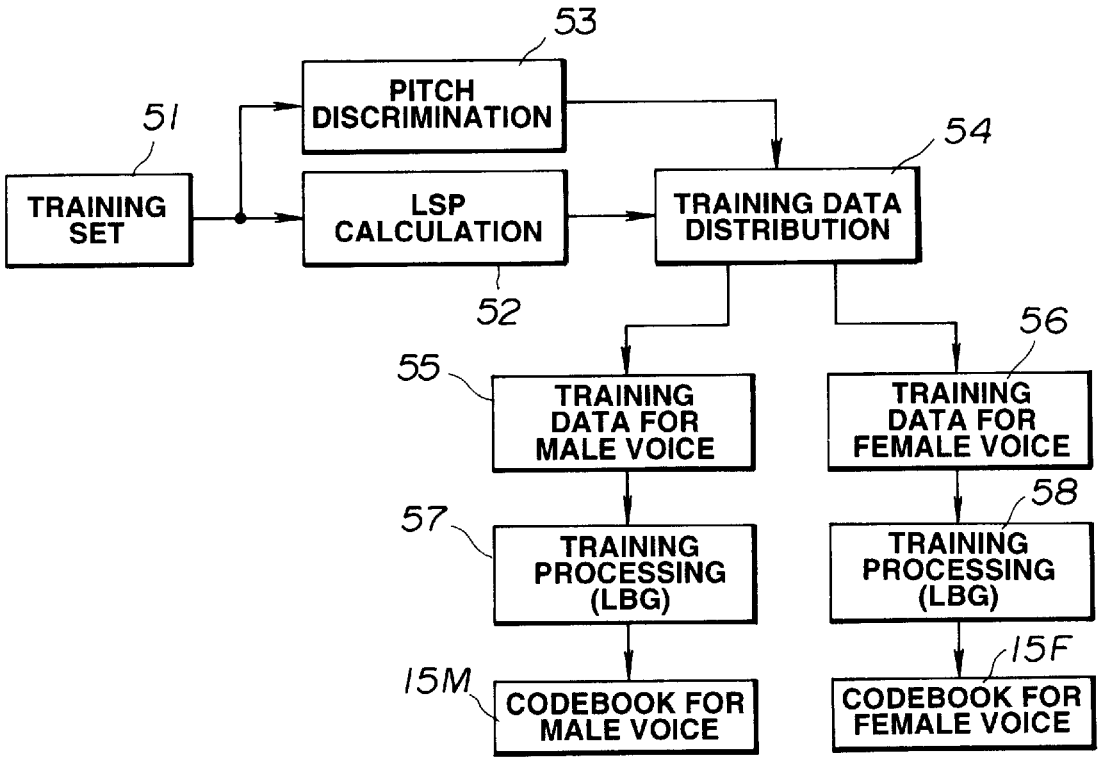
FIG. 3 is a block diagram for illustrating the method for forming a codebook (training method) employed for vector quantization.

That is, referring to FIG. 3, signals from a training set 51, made up of speech signals for training, continuing for e.g., several minutes, are supplied to a line spectral pair (LSP) calculating circuit 52 and a pitch discriminating circuit 53. The LRP calculating circuit 52 is equivalent to e.g., the LPC analysis circuit 12 and the α to LSP converting circuit 13 of FIG. 1, while the pitch discriminating circuit 53 is equivalent to the back filtering circuit 21 and the pitch detection circuit 22 of FIG. 1. The pitch discrimination circuit 53 discriminates the pitch lag P(k), pitch strength Pl(k) and the frame power $R_0(k)$ by the above-mentioned threshold values $P_{th}$, $Pl_{th}$ and $R_{0th}$ for case classification in accordance with the above conditions (i), (ii) and (iii). Specifically, discrimination between at least the male voice under the condition (i) and the female voice under the condition (ii) suffices. Alternatively, the pitch lag values P(k) of past n voiced frames with high pitch reliability may be preserved and a mean value of the P(k) values of these n frames may be found and discriminated by the threshold value $P_{th}$. An output of the smoother of FIG. 2 may also be discriminated by the threshold value $P_{th}$.

The LSP data from the LSP calculating circuit 52 are sent to a training data assorting circuit 54 where the LSP data are assorted into training data for male voice 55 and into training data for female voice 56 in dependence upon the discrimination output of the pitch discrimination circuit 53. These training data are supplied to training processors 57, 58 where training is carried out in accordance with e.g., the so-called LBG method for formulating the codebook 35M for male voice and the codebook 35F for female voice. The LBG method is a method for codebook training proposed in Linde, Y., Buzo, A. and Gray, R. M., "An Algorithm for vector Quantizer Design", in IEEE Trans. Comm., COM-28, pp. 84 to 95, January 1980. Specifically, it is a technique of designing a locally optimum vector quantizer for an information source, whose probabilistic density function has not been known, with the aid of a so-called training string.

The codebook 15M for male voice and the codebook 15F for female voice, thus formulated, are selected by switching the changeover switch 16 at the time of vector quantization by the vector quantizer 14 shown in FIG. 1. This changeover switch 16 is controlled for switching in dependence upon the results of discrimination by the pitch detection circuit 22.

The index information, as the quantization output of the vector quantizer 14, that is the codes of the representative vectors, are outputted as data to be transmitted, while the quantized LSP data of the output vector is converted by the LSP to α converting circuit 17 into α-parameters which are fed to a perceptual weighing synthesis filter 31. This perceptual weighing synthesis filter 31 has characteristics 1/A (z) as shown by the following equation (5):

$$\frac{1}{A(z)} = \frac{1}{1 + \sum_{i=1}^{P} \alpha_i Z^{-1}} * W(z) \tag{5}$$

where W(z) denotes perceptual weighting characteristics.

Among data to be transmitted in the above-described CELP encoding, there are the index information for the dynamic codebook 32 and the stochastic codebook 35, the index information of the gain codebook 37 and the pitch information of the pitch detection circuit 22, in addition to the index information of the representative vectors in the vector quantizer 14. Since the pitch values or the index of the dynamic codebook are parameters inherently required to be transmitted, the quantity of the transmitted information or the transmission rate is not increased. However, if the parameters not to be inherently transmitted, such as the pitch information, is to be used as a reference basis for switching between the codebook for male voice and that for the female voice, it is necessary to transmit separate code switching information.

It is noted that discrimination between the male voice and the female voice need not be coincident with the sex of the speaker provided that the codebook selection has been made under the same standard as that for assortment of the training data. Thus the appellation of the codebook for male voice and the codebook for female voice is merely the appellation for convenience. In the present embodiment, the codebooks are changed over depending upon the pitch value by exploiting the fact that correlation exists between the pitch value and the shape of the spectral envelope.

The present invention is not limited to the above embodiments. Although each component of the arrangement of FIG. 1 is stated as hardware, it may also be implemented by a software program using a so-called digital signal processor (DSP). The low-range side codebook of band-splitting vector quantization or the partial codebook such as a codebook for a part of the multi-stage vector quantization may be switched between plural codebooks for male voice and for female voice. In addition, matrix quantization may also be executed in place of vector quantization by grouping data of plural frames together. In addition, the speech encoding method according to the present invention is not limited to the linear prediction coding method employing code excitation but may also be applied to a variety of speech encoding methods in which the voiced portion is synthesized by sine wave synthesis and the non-voiced portion is synthesized based upon noise signal. As for the usage, the present invention is not limited to transmission or recording/reproduction but may be applied to a variety of different usages, such as pitch conversion speech modification, regular speech syntheses or noise suppression.

INDUSTRIAL APPLICABILITY

As will be apparent from the foregoing description, a speech encoding method according to the present invention provides a first codebook and a second codebook formed by assorting parameters representing short-term prediction values concerning a reference parameter comprised of one or a combination of a plurality of characteristic parameters of the input speech signal. The short-term prediction values are then generated based upon an input speech signal and one of the first and second codebooks is selected in connection with the reference parameter of the input speech signal. The short-term prediction values are encoded by having reference to the selected codebook for encoding the input speech signal. This improves the quantization efficiency. For example, the signal quality may be improved without increasing the transmission bit rate or the transmission bit rate may be lowered further while suppressing deterioration in the signal quality.

I claim:

1. A speech encoding method comprising the steps of:

generating short-term prediction coefficients based on an input speech signal;

providing first and second codebooks formed of assorted parameters representing said short-term prediction coefficients, said first and second codebooks relating to at least one of a plurality of characteristic parameters of said input speech signal;

selecting one of said first and second codebooks based on a pitch value of said input speech signal; and quantizing said short-term prediction coefficients using said selected codebook.

2. The speech encoding method as claimed in claim 1, wherein said plurality of characteristic parameters includes said pitch value, a pitch strength, a frame power, a voiced/unvoiced discrimination flag, and a gradient of a signal spectrum.

3. The speech encoding method as claimed in claim 1, wherein said step of quantizing includes vector-quantizing said short-term prediction coefficients.

4. The speech encoding method as claimed in claim 1, wherein said step of quantizing includes matrix-quantizing said short-term prediction coefficients.

5. The speech encoding method as claimed in claim 1, wherein said step of selecting includes selecting one of said first and second codebooks based on a magnitude relation between said pitch value of said input speech signal and a pre-set pitch value.

6. A speech encoding method comprising the steps of:

generating short-term prediction errors based on an input speech signal;

providing first and second codebooks formed of assorted parameters representing said short-term prediction errors, said first and second codebooks relating to at least one of a plurality of characteristic parameters of said input speech signal;

selecting one of said first and second codebooks based on a pitch value of said input speech signal; and quantizing said short-term prediction errors using said selected codebook.

7. The speech encoding method as claimed in claim 6, wherein said plurality of characteristic parameters includes said pitch value, a pitch intensity, a frame power, a voiced/unvoiced discrimination flag, and a gradient of a signal spectrum.

8. The speech encoding method as claimed in claim 6, wherein said step of quantizing includes vector quantizing said short-term prediction errors.

9. The speech encoding method as claimed in claim 6, wherein said step of quantizing includes matrix-quantizing said short-term prediction errors.

10. A speech encoding apparatus comprising:

short-term prediction means for generating short-term prediction coefficients based on an input speech signal;

first and second codebooks formed of assorted parameters representing said short-term prediction coefficients, said first and second codebooks relating to one or more of a plurality of characteristic parameters of said input speech signal;

selection means for selecting one of said first and second codebooks based on a pitch value of said input speech signal; and quantization means for quantizing said short-term prediction coefficients using said selected codebook.

11. The speech encoding apparatus as claimed in claim 10, wherein said plurality of characteristic parameters includes said pitch value, a pitch strength, a frame power, a voiced/unvoiced discrimination flag, and a gradient of a signal spectrum.

12. The speech encoding apparatus as claimed in claim 10, wherein said quantizing means vector-quantizes said short-term prediction coefficients.

13. The speech encoding apparatus as claimed in claim 10, wherein said quantizing means matrix-quantizes said short-term prediction coefficients.

14. A speech encoding apparatus comprising:

short-term prediction means for generating short-term prediction coefficients based on an input speech signal;

a first plurality of codebooks formed of assorted parameters representing said short-term prediction coefficients, said first plurality of codebooks relating to reference parameters of said input speech signal, said reference parameters including at least one of a plurality of characteristic parameters of said input speech signal;

selecting means for selecting one of said first plurality of codebooks based on said reference parameters of said input speech signal;

quantization means for quantizing said short-term prediction coefficients based on said codebook selected from said first plurality of codebooks;

a second plurality of codebooks formed on the basis of training data corresponding to said reference parameters; and synthesis means for synthesizing an excitation signal which relates to an output of a codebook selected from said second plurality of codebooks based on a quantized value from said quantization means.

15. The speech encoding apparatus as claimed in claim 14, wherein said plurality of characteristic parameters includes a pitch value, a pitch strength, a frame power, a voice/unvoiced discrimination flag, and a gradient of a signal spectrum.

16. The speech encoding apparatus as claimed in claim 14, wherein said quantization means vector-quantizes said short-term prediction coefficients.

17. The speech encoding apparatus as claimed in claim 14, wherein said quantization means matrix-quantizes said short-term prediction coefficients.

18. The speech encoding apparatus as claimed in claim 14, wherein said reference parameters include a pitch value of said input speech signal, and said selection means selects one of said first plurality of codebooks based on said pitch value of said input speech signal.

19. The speech encoding apparatus as claimed in claim 14, wherein each of said first plurality of codebooks and said second plurality of codebooks includes a codebook for a male voice and a codebook for a female voice.

* * * * *